US005313673A

United States Patent [19]

Saadi et al.

[11] Patent Number: 5,313,673

[45] Date of Patent: May 24, 1994

[54] ELECTRONIC FLUSH VALVE ARRANGEMENT

[75] Inventors: Robert E. Saadi, Erie; Christopher J. Ball, Moon Township, Allegheny County, both of Pa.; Makoto Kodaira, Tokyo, Japan

[73] Assignee: Zurn Industries, Inc., Erie, Pa.

[21] Appl. No.: 33,844

[22] Filed: Mar. 19, 1993

[51] Int. Cl.[5] ..... E03D 5/10

[52] U.S. Cl. ..... 4/313; 4/302; 4/305; 4/DIG. 3; 4/406

[58] Field of Search ..... 4/DIG. 3, 302, 303, 4/313, 416, 406, 305

[56] References Cited

U.S. PATENT DOCUMENTS

| | | | |
|---|---|---|---|
| 1,756,263 | 4/1930 | Sloan . | |
| 1,858,470 | 5/1932 | Sloan . | |
| 2,438,207 | 3/1948 | Darby | 4/99 |
| 2,603,794 | 7/1952 | Bokser | 4/101 |
| 3,339,212 | 9/1967 | Atkins et al. | 4/100 |
| 3,434,164 | 3/1969 | Forbes | 4/100 |
| 3,462,769 | 8/1969 | Ichimori et al. | 4/100 |
| 3,670,167 | 6/1972 | Forbes | 250/221 |
| 3,695,288 | 10/1972 | Billeter et al. | 137/360 |
| 3,731,025 | 5/1973 | Filliung | 200 R/1.9 R |
| 3,863,196 | 1/1975 | Hilles | 340/1 R |
| 4,141,091 | 2/1979 | Pulvari | 4/313 |
| 4,202,525 | 5/1980 | Govaer et al. | 251/40 |
| 4,309,781 | 1/1982 | Lissau | 4/304 |
| 4,327,891 | 5/1982 | Allen et al. | 251/38 |
| 4,606,085 | 8/1986 | Davies | 4/DIG. 3 |
| 4,624,017 | 11/1986 | Foletta | 4/304 |
| 4,667,350 | 5/1987 | Ikenaga et al. | 4/304 |
| 4,707,867 | 11/1987 | Kawabe et al. | 4/313 |
| 4,742,583 | 5/1983 | Yoshida et al. | 4/313 |
| 4,791,287 | 11/1990 | Shaw | 251/30.05 |
| 4,793,588 | 12/1988 | Laverty, Jr. | 251/30.03 |
| 4,805,247 | 2/1989 | Laverty, Jr. | 4/304 |
| 5,062,453 | 11/1991 | Saadi et al. | 137/624.11 |
| 5,125,621 | 6/1992 | Parsons et al. | 251/30.03 |
| 5,165,465 | 11/1992 | Kenet | 165/2 |
| 5,169,118 | 12/1992 | Whiteside | 251/30.03 |
| 5,187,818 | 2/1993 | Barret, Sr. et al. | 4/406 |
| 5,195,720 | 3/1993 | Nortier et al. | 251/129.04 |

*Primary Examiner*—Henry J. Recla
*Assistant Examiner*—Gregory M. Vidovich
*Attorney, Agent, or Firm*—Webb, Burden, Ziesenheim & Webb

[57] ABSTRACT

A sensor for a flushing device having an electric solenoid operated flush valve. The sensor includes a control box, a first radiation emitting source mounted in the control box, a radiation detector adapted to detect reflected radiation from the first radiation emitting source mounted in the control box, a lens cover attached to the control box and adapted to permit radiation to pass therethrough and a control circuit contained within the control box responsive to the sensing unit and connected to the solenoid for initiating operation of the flush valve. The control circuit includes a magnetically activated device for bypassing the sensing unit to initiate operation of the flush valve and deactivate the flush valve for a fixed period of time. Also disclosed is a method of operating the sensor.

21 Claims, 8 Drawing Sheets

ELECTRONIC FLUSH VALVE ARRANGEMENT

BACKGROUND OF THE INVENTION

1. Field of the Invention

This invention relates to the operation of flush valves and, more particularly, to non-contact sensor operated mechanisms for operating flush valves.

2. Description of the Prior Art

The use of flush valves for controlling the flow of water to plumbing fixtures, particularly public facilities, is well-known. Such flush valves typically include a movable diaphragm which closes the water supply and is tripped by a handle operated trip mechanism. See, for example, U.S. Pat. Nos. 1,756,263; 1,858,470; 4,202,525 and 4,327,891. Push button arrangements for tripping diaphragm flush valves have also been developed. See, for example, U.S. Pat. Nos. 3,695,288 and 3,778,023. All of these arrangements provide controlled, on demand flushing of the plumbing fixture through controlling the flush valve trip mechanism.

It has long been recognized that human contact with the handle, push button or other device for tripping the flush valve is not particularly sanitary, especially in heavily used public restroom facilities. It has also been recognized that non-contact arrangements for tripping a flush valve are desirable. The most common non-contact method activating a flush valve is the use of a sensor operated system. See, for example U.S. Pat. Nos. 2,438,207; 2,603,794; 3,339,212; 3,434,164; 3,462,769; 3,670,167; 3,863,196; 4,309,781; 4,624,017; 4,667,350; 4,707,867; 4,742,583; 4,793,588 and 4,805,247. These systems provide for automatic tripping of the flush valve by first detecting when a person is present at the plumbing fixture, then detecting when the person leaves the fixture and then triggering the flush mechanism for the fixture. All these systems provide for non-contact and sanitary flushing of the plumbing fixture; it does so at the expense of the user's direct control of the flush mechanism, which is present in the handle and the push button operated systems. To overcome this deficiency, several sensor operated flush valves have incorporated a push button override. This override enables the user or maintenance worker to flush the flushing device on demand. However, the mechanical override is unsanitary and subject to vandalism--like the above-identified on demand systems.

Furthermore, the above-described sensor operated flush valves without the mechanical override tend to make maintenance procedures on the urinal or toilet difficult. Specifically, after a maintenance worker applies cleaning solution to the toilet bowl or the urinal bowl, he or she must move away from the bowl to activate the flush valve to clear the cleaning solution from the bowls. This is a cumbersome procedure and in many cases ignored. Also, if a maintenance person must do work to the bowl, for example check for leaks, the flush valve needs to be disabled. This requires either shutting off the electrical power to the sensor or the flush valve and typically involves removing a face plate from the sensor to obtain access to a power control box. This procedure is likewise cumbersome and time-consuming.

Accordingly, it is an object of our present invention to provide a non-contact sensor for operating a flush valve in which a maintenance worker can easily disable or override the sensor while a user cannot easily disable or override the sensor.

SUMMARY OF THE INVENTION

Our invention is a sensor for a flushing device having an electronic solenoid operated flush valve which includes a control box, a first radiation emitting source mounted to the control box and a radiation detector adapted to detect reflected radiation from the first radiation emitting source mounted in the control box. The first radiation emitting source and the radiation detector form a sensing unit, which preferably operates within the infrared radiation range. The sensor also includes a replaceable lens cover attached to the control box which is adapted to permit radiation to pass therethrough. The lens cover is directly spaced apart from the sensing unit. A control circuit is contained within the control box and is responsive to the sensing unit and is connected to the solenoid for initiating operation of the flush valve. The control circuit includes a magnetically activated device, such as a reed switch, for bypassing the sensing unit to initiate operation of the flush valve and deactivate the flush valve for a fixed period of time. Optionally, the sensor includes a battery powered power supply electrically coupled to the control circuit.

If the magnetically activated device for bypassing the sensing unit is activated within a first time period, then operation of the flush valve is initiated and if the device is activated within a second time period, then the flush valve is inoperable. Preferably, the first time period is less than three seconds and the second time period is greater than or equal to three seconds.

The first radiation emitting source and the radiation detector provide a zone of detection of a user of a flushing device. The circuit includes a device for varying the zone of detection such as a potentiometer.

The sensor further includes a second radiation emitting source positioned adjacent to the first radiation emitting source, an arrangement for indicating operational modes of the sensor and a device for manually resetting the control circuit. The control circuit also includes a capacitor, which when discharged operates the solenoid so that the flush valve opens and permits the flushing device to flush.

Furthermore, the sensor includes a plurality of leads attached to the control circuit and passed through the control box at a lead control box interface. The leads connect to the interface. The interface forms a waterproof seal between the leads and the control box. A gasket is sandwiched between the lens cover and the control box, whereby a waterproof seal is formed by the sandwiched gasket. Accordingly, the control box and the lens cover define a waterproof internal chamber, which contains the control circuit.

Our invention also includes a method for operating a flush valve described hereinabove having the steps of placing a magnet adjacent to the device for bypassing the sensing unit; activating the device for bypassing the sensing unit with a magnet; removing the magnet away from the means for bypassing the sensing unit; determining a length of time in which the magnet activated the device for bypassing the sensing unit; and automatically performing one of two steps depending on the length of time in which the magnet activated the device for bypassing the sensing unit. The two steps are (a) activating the solenoid valve; or (b) disabling the solenoid valve. When the length of time in which the magnet activated the device for bypassing the sensing unit is less than a first length of time, the flushing device automatically flushes; if the length of time is greater than or equal to the first length of time, the flushing device is deactivated, preferably for a fixed period of time.

DESCRIPTION OF THE PREFERRED EMBODIMENT

Figure 1:
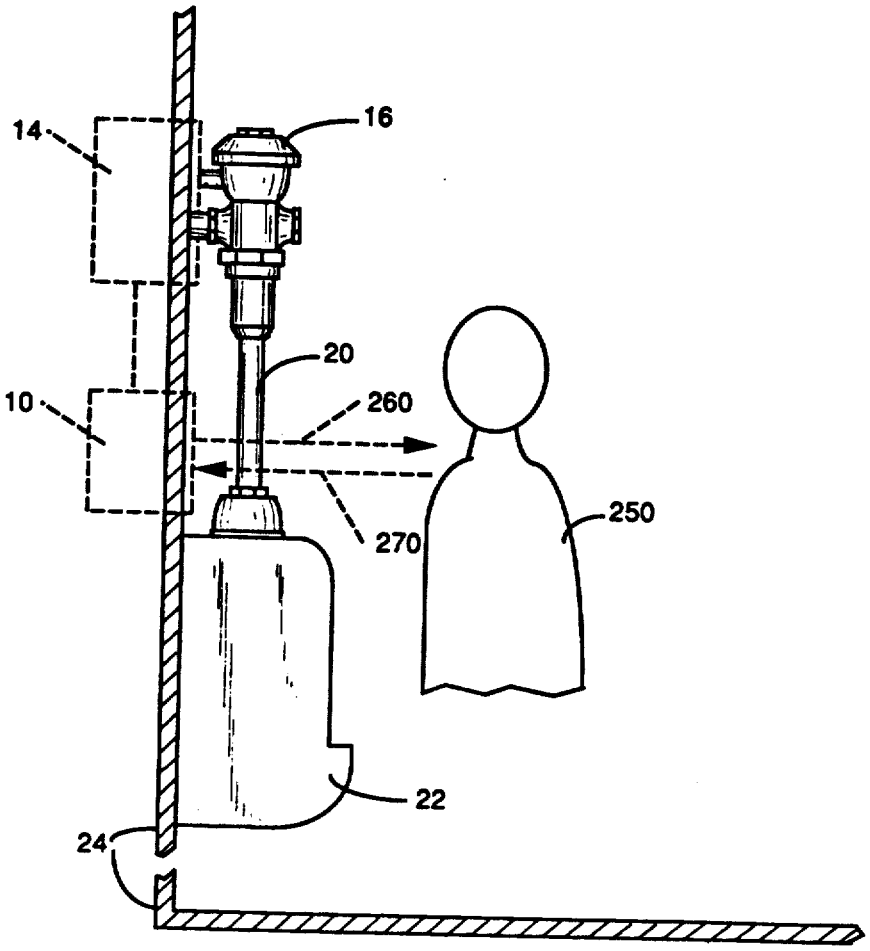
FIG. 1 is a side view, partially in section, including an installed non-contact sensor control for operating a flush valve made in accordance with the present invention.
Figure 2:
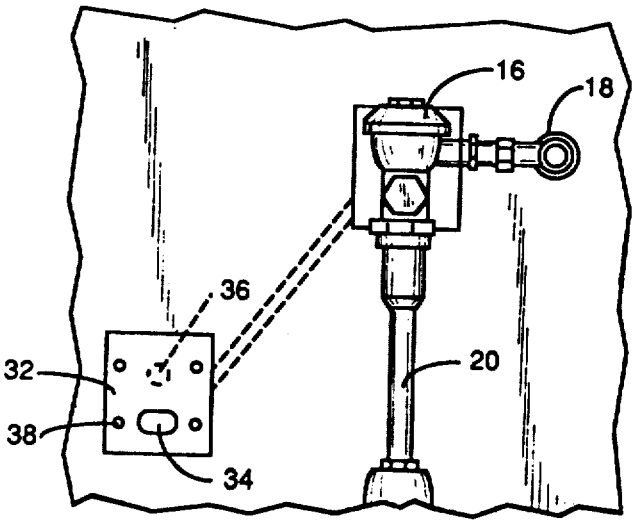
FIG. 2 is front view of the installed sensor shown in FIG. 1.

A non-contact sensor for operating a flush valve of the present invention is shown in general in FIGS. 1 and 2. The sensor 10 generally includes a control box which contains a control unit. The electrical output of the control unit is supplied to a solenoid 14. Actuation of the solenoid 14 operates a flush valve 16. The flush valve 16 is connected to a water inlet pipe 18 and an outlet pipe 20 which is connected to a urinal 22 (or alternatively a toilet). The operation of the solenoid 14 and flush valve 16 is similar as described in the U.S. Pat. No. 5,062,453, which is hereby incorporated by reference. The sensor 10 is mounted on a wall 24.

The sensor 10 includes a control box 30, a wall face plate 32 and a lens cover 34 centrally positioned in the wall face plate 32, see FIG. 2. An optional push button override 36, shown in phantom, extends outwardly from the wall face plate 32 and permits a user to manually flush the urinal 22. Fasteners 38 attach the wall face plate 32 to the wall 24.

Figure 3A:
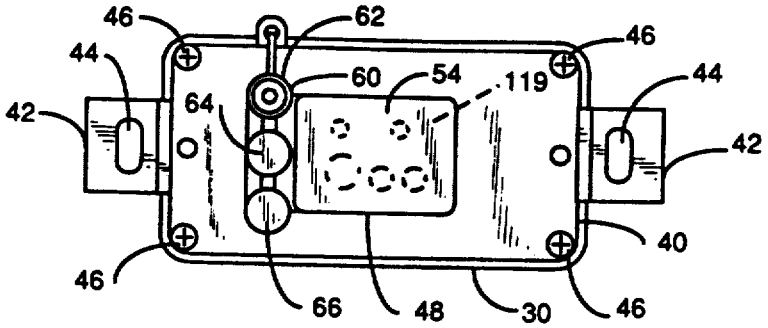
FIG. 3*a* is a front view of a sensor with a plug cap set in a plug slot made in accordance with the present invention.
Figure 3B:
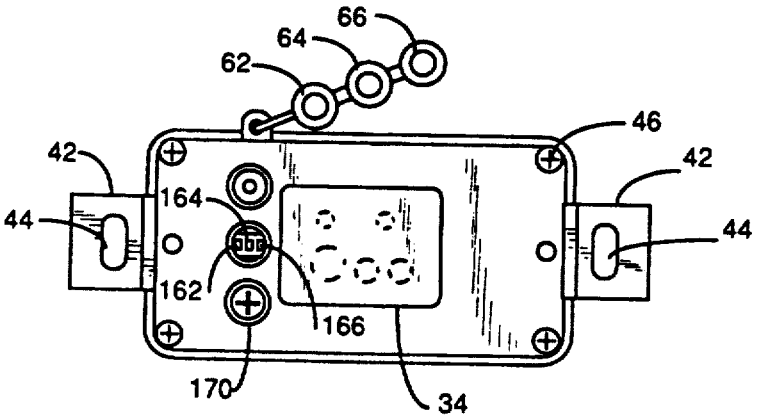
FIG. 3*b* is a front view of the sensor shown in FIG. 3*a* with the plug from the plug slot.
Figure 6:
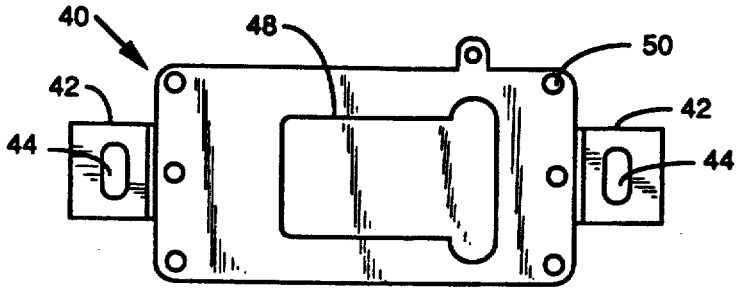
FIG. 6 is a top view of an attaching bracket of the sensor made in accordance with the present invention.

The sensor 10 also includes an attaching bracket 40, as shown in FIG. 6, that includes two oppositely placed tabs 42 having slots 44 therein for receipt of wall holding fasteners. The bracket 40 also includes an internal slot 48 through which the lens cover 34 passes and a plurality of screw receiving slots 50 that receive screws 46 which hold the lens cover and the bracket 40 to the control box 30. A rubber cover plug 60 having circular plug areas 62, 64 and 66 attaches to the attaching bracket 40, FIGS. 3*a*-3*b*. Fasteners (not shown) pass through slots 44 for holding the bracket 40 and in turn the control box 30 to an inner side of the wall 24.

Figure 7:
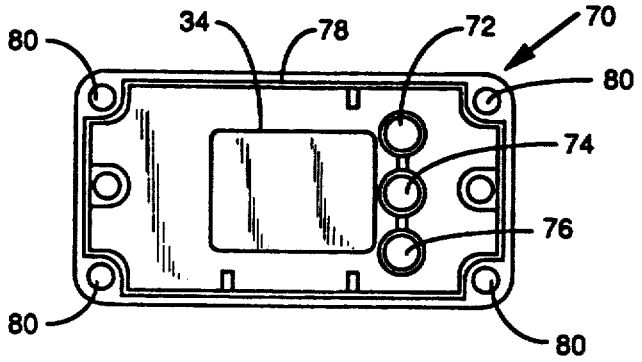
FIG. 7 is a bottom view of a front cover of the sensor made in accordance with the present invention.

The lens cover 34 is integral to a front cover 70, as shown in detail in FIG. 7. Preferably, the front cover 70 is made of an optical grade of plastic material, such as Parapet, which is adapted to permit light to pass therethrough. The front cover 70 includes plug receiving holes 72, 74 and 76. A lower edge of the front cover 70 includes a gasket forcing member lip 78. Screw receiving holes 80 are provided around the corners of the front cover 70 through which screws 46 pass so that a portion of the front cover 70 is sandwiched between bracket 40 and control box 30.

Figure 8A:
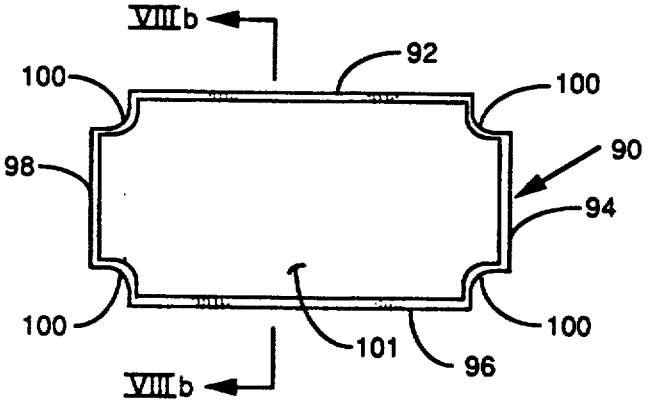
FIG. 8*a* is a top view of a gasket of the sensor made in accordance with the present invention.
Figure 8B:
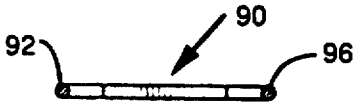
FIG. 8*b* is a section taken along lines VIIIb—VIIIb in FIG. 8.

A gasket 90, as shown in FIGS. 8*a* and 8*b*, made of Styrene-butadiene Rubber (SBR) or rubber is sandwiched between the front cover 70 and the control box 30. The gasket 90 includes a first member 92, a second member 94, a third member 96 and a fourth member 98. The members 92, 94, 96 and 98 connect to each other by curved connecting members 100 forming a somewhat rectangular shape having inverted corners. This is the same shape as gasket forcing member lip 78. An internal area 101 is defined by the gasket members 92, 94, 96, 98 and 100.

Figure 9:
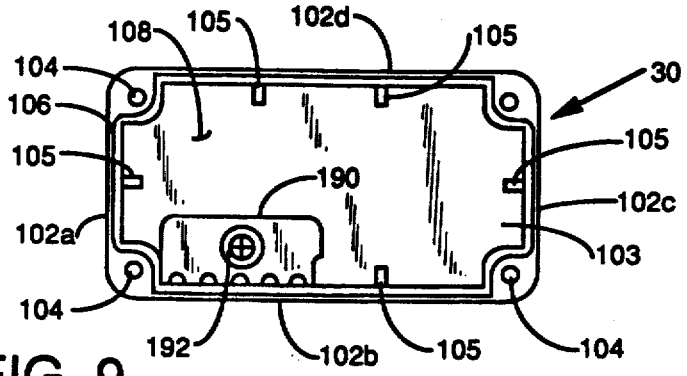
FIG. 9 is a top view of a control box of the sensor made in accordance with the present invention.

The control box 30, as shown in FIG. 9, is a substantially closed bottom, open topped rectangular shaped box that includes side walls 102*a*, 102*b*, 102*c* and 102*d* and a back wall 103. An internal cavity 108 is defined by walls 102*a*-102*d* and 103. A plurality of support ribs 105 extend along walls 102*a*-102*d*. Four threaded holes 104 are provided on respective corners of the control box 30. A gasket receiving recess 106 is provided along an upper edge of the control box 30. The gasket receiving recess 106 is substantially the same shape as gasket 90. Gasket 90 is received by the recess 106.

Figure 10:
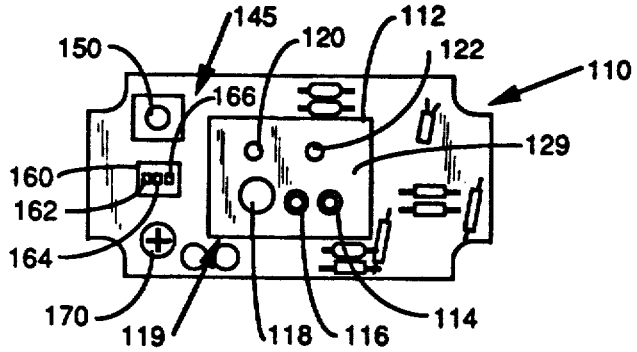
FIG. 10 is a top view of a control circuit board of the sensor made in accordance with the present invention.
Figure 11A:
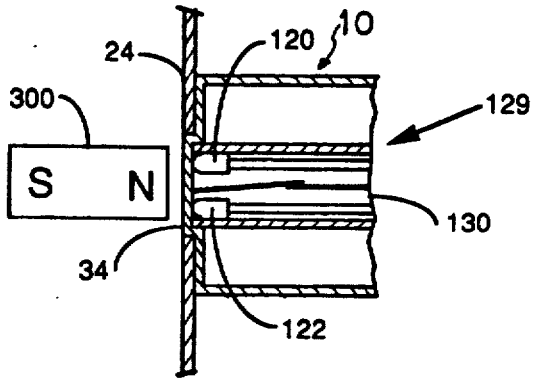
FIG. 11*a* is a side view, partially in section, showing a portion of a magnetic override switch of the sensor made in accordance with the present invention.
Figure 11B:
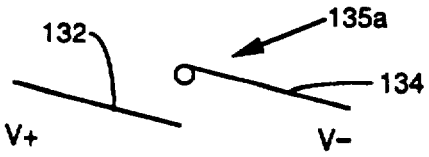
FIG. 11*b* is a partial circuit diagram of the magnetic override switch in an open position.
Figure 11C:
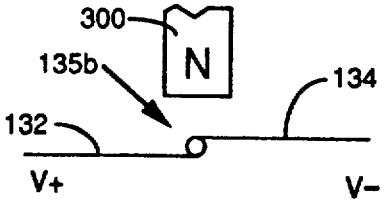
FIG. 11*c* is a partial circuit diagram with the magnetic override switch in a closed position.

A circuit board/control circuit 110, as shown in FIG. 10, is received partially within the internal cavity 108 of the control box. The circuit board/control circuit 110 incorporates an integrated circuit microprocessor 111. (One such integrated circuit is Model No. US2411QF manufactured by Sharp Corporation.) The circuit board/control circuit 110 is supported by upper surfaces of ribs 105. The circuit board 110 includes a sensing unit 112 that has infrared radiation LED emitters 114 and 116 and a light receiver 118. Emitters 114 and 116 are positioned adjacent to each other. The use of two emitters results in a stronger output than the use of one emitter. Further, the circuit board 110 includes an indicator unit 119 having a green indicator light 120 and a red indicator light 122. The circuit board 110 also includes a magnetic disabling unit 129 that includes a magnetic reed switch 130, as shown in FIG. 11*a*. The reed switch 130 includes contact wires 132 and 134 that normally do not contact each other and form an open circuit 135*a*, as shown in FIG. 11*b*. (One such reed switch is an SPST Form A Reed Switch such as that manufactured by Hamlin and described on page 648 of Allied Electronics 910 Engineering Manual And Purchasing Guide © 1991.) The reed switch contact wires 132 and 134 contact each other when a magnetic field is placed in close proximity thereto, causing the formation of a closed circuit 135*b*, as shown in FIG. 11*c*.

Figure 5:
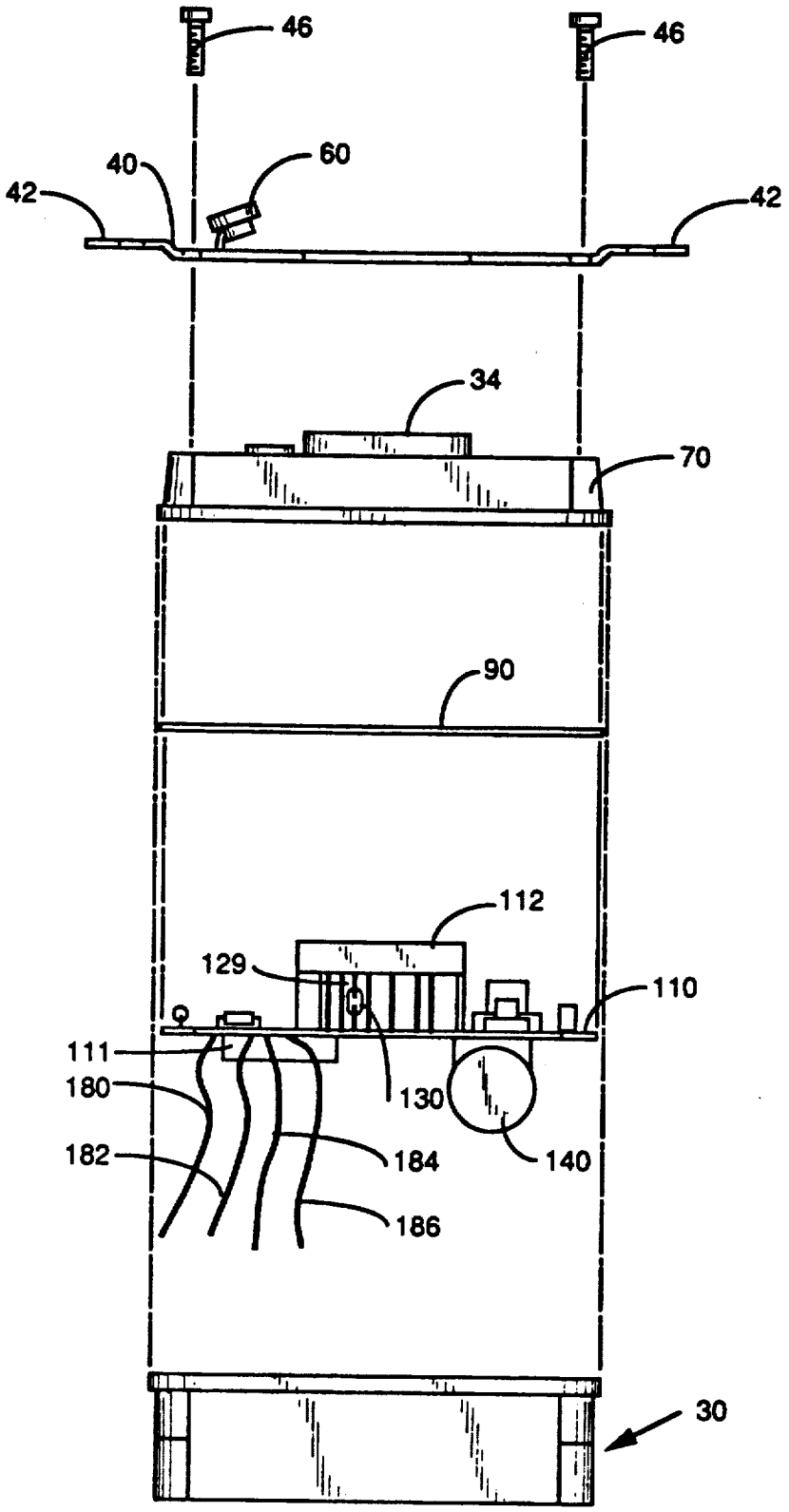
FIG. 5 is an exploded side view of the sensor shown in FIG. 3*a;*

Furthermore, a 6800 μF capacitor 140 is provided on the circuit board 110 for assisting in opening the solenoid 14, see FIG. 5. An adjustment unit 145 is also provided on the circuit board 110 that includes a reset button 150, a dip switch 160 having on/off switches 162, 164 and 166 and a range potentiometer 170, see FIG. 10.

Figure 4:
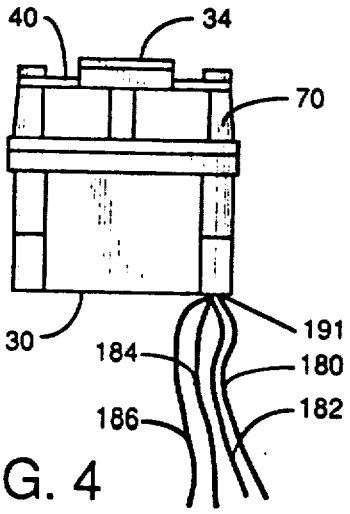
FIG. 4 is a side view of the sensor shown in FIG. 3*a;*

Electrical leads 180, 182, 184 and 186 attach to circuit board 110 and pass through a clamping member 190 and the control box 30 defining a lead control box interface 191, see FIG. 5. Clamping member 190 includes a cavity filled with a waterproof material, such as a silicone based latex, and attaches to the back wall 103 by a screw 192 thereby forming a waterproof seal between leads 180, 182, 184 and 186 and control box 30, see FIG. 9. Clamping member 190 rigidly clamps the leads 180, 182, 184 and 186 so that if an external force is applied to the leads 180, 182, 184 and 186, the external force is not transferred to the control circuit 110, which could be damaged or broken, FIGS. 4 and 5. Further, the waterproof material forms a waterproof seal between the leads 180, 182, 184 and 186 and the control box 30 thereby preventing water from leaking around the leads 180, 182, 184 and 186 and the control box 30 into the internal cavity 108 and in turn onto the control board 110. This averts a possible electrical short and a corrosion problem.

Figure 12:
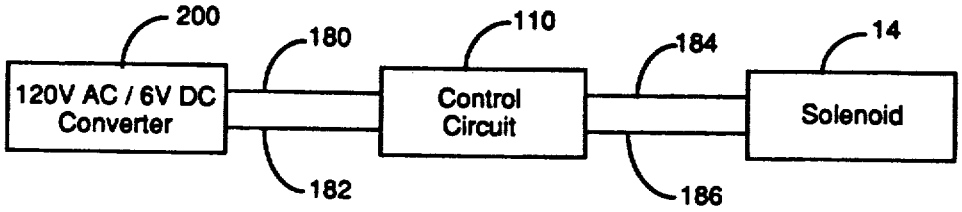
FIG. 12 is a schematic block diagram of the sensor connected to a solenoid operated flush valve.
Figure 13:
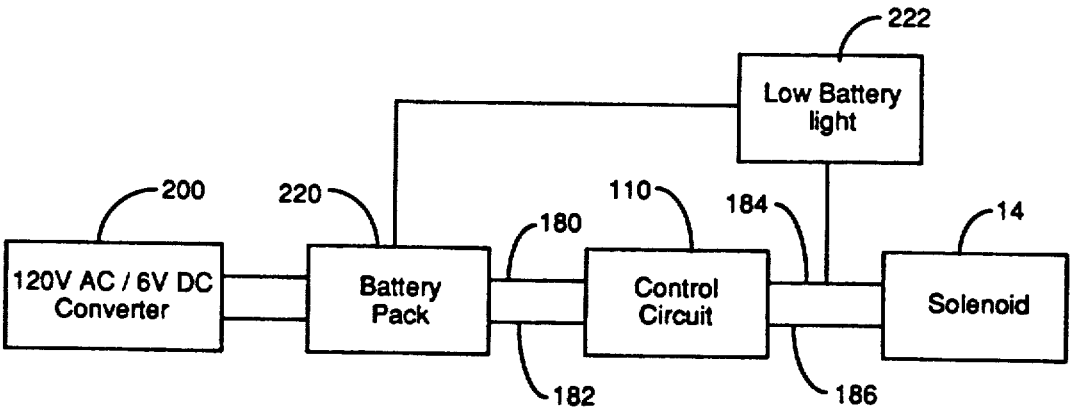
FIG. 13 is a schematic block diagram of the sensor connected to a solenoid operated flush valve and a battery back-up.

Leads 180 and 182 are adapted to be connected to a power source, i.e., a converter 200, and leads 184 and 186 are adapted to be attached to the solenoid 14, as shown in FIG. 12. Preferably, the control board 110 includes an arrangement (not shown) that requires the proper electrical plurality of leads 180 and 182 for power to be supplied to the sensing unit 112. Such an arrangement is well-known in the art. This protects the sensing unit 112 from improper electrical polarity. Alternatively, a battery back-up pack 220 including four D size batteries and a low battery light indicator 222 may be included, as shown in FIG. 13. Should the power source 200 fail, the battery back-up can operate the sensor 10 and solenoid 14 for a limited time.

The sensor 10 is assembled as follows, FIGS. 3*a*–9. Leads 180, 182, 184 and 186 are passed through control box 30. The clamping member 190 is filled with the waterproof material and then attached to the control box 30 by the screw 192. The circuit board is then placed within cavity 108 resting on support ribs 105. Gasket 90 is placed within gasket receiving recess 106. The front cover 70 is then placed over the circuit board 110, so that the gasket forcing member lip 78 is received in the gasket receiving recess contacting gasket 90. The sensing unit 112 is directly spaced apart from the lens cover 34 and the reset switch 150. The dip switch 160 and the potentiometer 170 are positioned directly below holes 72, 74 and 76, respectively. Bracket 40 is then placed on top of front cover 70 so that lens cover 34 passes through internal slot 48 and plug receiving holes 72, 74 and 76 are positioned within slot 48. Screws 46 then pass through respective bracket slots 50, front cover holes 80 and threaded holes 104 and tightened. This causes compression of the gasket 90 by lip 78 and thereby forming a waterproof seal between the front cover 70 and the control box 30. Further, screws 46 are positioned outside of gasket internal area 101 so that the circuit board 110 is contained within a chamber 230 which is defined by inner surfaces of the control box 30 and an inner surface of the front cover 70. The cover plug areas 62, 64 and 66 are forcibly received by respective holes 72, 74 and 76 forming a water-tight seal between the plug area and the front cover 70 thereby rendering chamber 230 into a waterproof chamber. When cover plug 60 is attached to front cover 70, cover plug area 62 is in close proximity to reset switch 150 so that reset switch 150 can be activated by depressing plug area 62. Should the lens cover 34 be scratched or broken during operation, it is easily replaceable by replacing front cover 70 with a new front cover.

Figure 14:
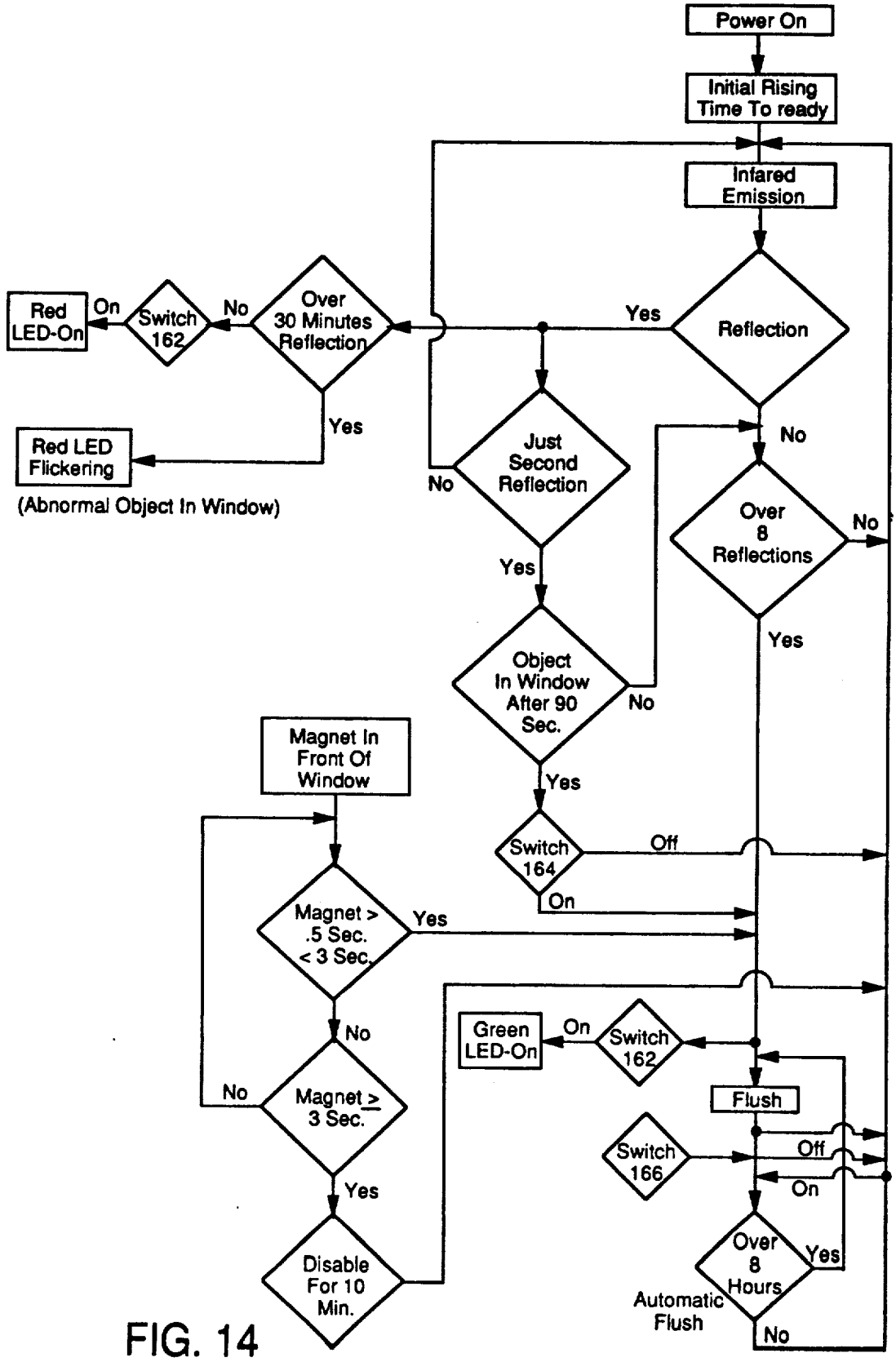
FIG. 14 is a schematic block diagram showing the operation of the sensor.

Operation of the sensor 10 is set forth below and is schematically shown in FIG. 14. When a person 250 is present in a defined viewing area in front of the sensor 10, an oscillator causes emitters 114 and 116 to emit modulated or pulsed infrared light rays 260 that pass through lens cover 34, FIGS. 1 and 10. Preferably, the emitters are pulsed at one second intervals. A portion of rays 260 reflect from the person 250 as indicated by rays 270 to receiver 118. The red light indicator 122 is then activated if the person remains in front of the sensor for at least one pulse. When the person 250 moves away from the viewing area of the sensor 10, the beam of reflected light to the receiver 118 is broken. Then, the green indicator light 120 activates if eight pulses are received and the red indicator light deactivates. Then, the control circuit 110 causes capacitor 140 to discharge and activate the solenoid 14 thereby opening the flush valve 16 and flushing the urinal 22. The indicator lights 120 and 122 help assure the person 250 that the flushing device is operational. The circuit of the circuit board 110 is automatically reset and the green indicator light 120 is deactivated and the urinal and sensor are immediately ready to receive another person. Optionally, if the sensor 10 detects an object for more than thirty minutes, then the red indicator light 122 flashes on and off at one second intervals.

Operation of the adjustment panel 145 is set forth below. The viewing area or zone of detection range depends on the strength of the emitters 114 and 116 and/or the receiver 118, FIG. 10. Rotation of the potentiometer 170 in the clockwise direction increases the range and rotation of the potentiometer 170 in the counterclockwise direction decreases the range. Preferably, the range should be adjustable between twelve inches to sixty inches.

The indicator lights 120 and 122 can also be used for diagnostic purposes. For example, when adjusting the emitter range, a maintenance person need only move his or her hand or body toward the sensor. The red indicator light 122 will activate when the hand or body is within the indicating range. Accordingly, the range can easily be changed as discussed above. Further, in operation the red indicator light 122 indicates that the sensor 10 and the converter 200 are operational and the green indicator light 120 indicates that power is going to solenoid 14. Therefore, if, for example, the green indicator light 120 activates during use but the urinal 22 does not flush, then either the flush valve 16 or the solenoid 14 are faulty.

On/off switch 162 activates or deactivates indicator lights 120 and 122. On/off switch 164 activates or deactivates a courtesy flush, which provides fresh water to the urinal 22 before use, after detecting two reflected pulses in a row. On/off switch 166 activates or deactivates a flush mode after eight hours since the last use. This feature assures fresh water is provided to the flushing device on a regular basis. Reset switch 150 resets all control board circuits when any switch 162, 164 and 166 is changed from one position to another and is activated by depressing plug area 62.

As discussed previously, prior art non-contact sensor activating flush valves pose several problems in regard to routine maintenance. For example, if a maintenance worker places cleaning solution in the urinal or toilet bowl and wants to flush the bowl, the maintenance worker must move a sufficient distance away from the sensor to activate the solenoid and flush valve. The maintenance worker then must re-approach the bowl to determine if it is properly cleaned. In some cases, the maintenance worker will not re-approach the bowl because of the inconvenience. Furthermore, routine maintenance may require disabling the sensor for a certain period of time. Prior art devices typically require the power to the solenoid to be deactivated. This is a time-consuming and an inconvenient procedure for the maintenance worker typically requiring dismantling of a cover plate to reach a power shut-off switch.

Applicants' invention overcomes these inconveniences by incorporating the reed switch 130 into the sensor 10 which acts as a magnetic override feature. The function of the magnetic override feature as magnetized object 300 in front of the lens cover 34 and dispressed externally of the sensor box 10. Contact wire 132 of the reed switch is magnetized causing contact wire 134 of the reed switch 130 to be pulled to the magnetized contact wire 132. Once the circuit is closed, the microprocessor counts how long this circuit is held in the closed position. If the circuit is held closed for more than one-half of a second but less than three seconds, the microprocessor sends a signal to discharge the capacitor 140 so that a flush will be initiated. If the circuit is held closed for three seconds or more, the microprocessor causes the sensor 10 to be disabled for ten minutes. At the end of the ten-minute period, the sensor will go back into normal operation. If a magnet is placed in front of the lens cover 34 for one-half of a second to less than three seconds during this ten-minute period, the function is canceled. If a magnet is held in front of the sensor window for more than three seconds during this ten-minute period, a new ten-minute period will start. The ten-minute timing functions are non-accumulative.

Accordingly, as shown in FIGS. 11*a* and 11*c*, when a maintenance worker places a magnet 300 adjacent to the lens cover 34 at a distance sufficient to activate the reed switch 130 for a time period of less than three seconds and more than one-half of a second, then the solenoid 14 is activated thereby causing flushing of the urinal 22. However, if the magnet 300 is held at a distance sufficient to activate the reed switch 130 three or more seconds, then the solenoid 14 and flush valve 16 are deactivated for ten minutes. The deactivate feature can be removed during that ten-minute interval by activating the reed switch 130 with the magnet 300. The above time periods can be varied according to the requirements of the maintenance staff. Thereby, the reed switch 130 permits activation and deactivation of the flushing device by bypassing the sensing unit 112. Accordingly, routine maintenance procedures can easily and conveniently be performed on a flushing device incorporating sensor 10.

It is to be noted that the above-described sensing device 10 can likewise be used for any type of flushing device, such as a toilet.

Having described herein the presently preferred embodiment of the present invention, it is to be understood that the invention may be otherwise embodied within the scope of the appended claims.

We claim:

1. A sensor for a flushing device having an electric solenoid operated flush valve, said sensor comprising:

a control box;

a first radiation emitting source mounted in said control box;

a radiation detector adapted to detect reflected radiation from said first radiation emitting source mounted in said control box, said first radiation emitting source and said radiation detector forming a sensing unit;

a lens cover attached to said control box and adapted to permit radiation to pass therethrough to and from said sensing unit, said lens cover being spaced apart on one side thereof from said sensing unit; and a control circuit contained within said control box responsive to said sensing unit and connected to the solenoid for initiating operation of said flush valve, said control circuit including means approximate said lens cover for bypassing said sensing unit for deactivating said flush valve, said means for bypassing said sensing unit being magnetically activated when subjected to a magnetic member disposed on the opposite side of said lens cover.

2. The sensor of claim 1 wherein said means for bypassing said sensing unit includes a magnetically activated reed switch.

3. The sensor of claim 2 wherein when said means for bypassing said sensing unit is activated within a first time period, operation of said flush valve is initiated and when said means for bypassing said sensing unit is activated within a second time period greater than said first period, said flush valve is inoperable.

4. The sensor of claim 3 wherein said first time period is less than three seconds and said second time period is greater than or equal to three seconds.

5. The sensor of claim 1 wherein said lens cover is replaceable.

6. The sensor of claim 1 further comprising a gasket sandwiched between said lens cover and said control box whereby a waterproof seal is formed by said sandwiched gasket.

7. The sensor of claim 6 further comprising a plurality of leads attached to said control circuit and passing through said control box at a lead control box interface, said leads connected to said interface, said interface forming a seal between said leads and said control box so that said control box and said lens cover define a waterproof internal chamber, which contains said control circuit.

8. The sensor of claim 1 further comprising a second radiation emitting source positioned adjacent to said first radiation emitting source.

9. The sensor of claim 1 further comprising means for indicating operational modes of said sensor.

10. The sensor of claim 1 wherein said control circuit includes means for manually resetting said control circuit.

11. The sensor of claim 1 wherein said first radiation emitting source and said radiation detector provide a zone of detection of a user of said flushing device, said control circuit having means for varying said zone of detection.

12. The sensor of claim 1 wherein said control circuit includes a capacitor which when discharged operates said solenoid so that said flush valve opens and permits the flushing device to flush.

13. The sensor of claim 1 further comprising a battery powered power supply electrically coupled to said control circuit.

14. The sensor of claim 1 wherein said sensing unit operates in the infrared radiation range.

15. A method for operating a flushing device that includes a sensor for a flushing device having an electric solenoid operated flush valve, said sensor comprising:

a control box;

a first radiation emitting source mounted in said control box;

a radiation detector adapted to detect reflected radiation from said first radiation emitting source and said first radiation emitting source and said radiation detector forming a sensing unit;

a lens cover attached to said control box and adapted to permit radiation to pass therethrough to and from said sensing unit, said lens cover spaced apart on one side thereof from said sensing unit; and a control circuit contained within said control box responsive to said sensing unit and connected to the solenoid for initiating operation of said flush valve, said control circuit including means approximate said lens cover for bypassing said sensing unit for deactivating said flush valve, said means for bypassing said sensing unit being magnetically activated when subjected to a magnet disposed on the opposite side of said lens cover;

said method includes the steps of:

placing a magnet on the opposite side of said cover and adjacent to said means for bypassing said sensing unit;

activating said means for bypassing said sensing unit by said magnet;

determining a predetermined length of time which said magnet activated said means for bypassing said sensing unit; and removing said magnet away from said means for bypassing said sensing unit performing one of the following steps depending on the determined predetermined length of time which said magnet activated said means for bypassing said sensing unit:

a) activating the solenoid operated flush valve when said predetermined length of time is within a first time interval; or b) disabling the solenoid operated flush valve when said predetermined length of time is greater than said first time interval.

16. The method of claim 15 wherein if the length of time which said magnet activated said means for bypassing said sensing unit is less than a first length of time, then said flushing device automatically flushes; and if the length of time is greater than or equal to the first length of time, then said flushing device is deactivated.

17. The method of claim 15 wherein said disabling of said flush valve is for a fixed period of time.

18. A sensor for a flushing device having an electric solenoid operated flush valve, said sensor comprising:

a control box;

a first radiation emitting source mounted in said control box;

a radiation detector adapted to detect reflected radiation from said first radiation emitting source mounted in said control box, said first radiation emitting source and said radiation detector forming a sensing unit;

a lens cover attached to said control box and adapted to permit radiation to pass therethrough to and from said sensing unit, said lens cover spaced apart on one side thereof from said sensing unit;

a control circuit contained within said control box responsive to said sensing unit and connected to the solenoid for initiating operation of said flush valve, said control circuit including means approximate said lens cover for bypassing said sensing unit, said means for bypassing said sensing unit being magnetically activated when subjected to a magnet disposed on the opposite side of said lens cover for a predetermined length of time, said means for bypassing said sensing unit including:

means for determining said predetermined length of time which said means for bypassing said sensing unit is activated; and means for performing one, of the following steps depending on the determined predetermined length of time which said means for bypassing said sensing unit is activated:

a) activating the solenoid operated flush valve when said predetermined length of time is within a first time interval; or b) disabling the solenoid operated flush valve when said predetermined length of time is greater than said first time interval.

19. The sensor of claim 18 wherein said means for bypassing includes a magnetically activated reed switch.

20. In combination, a magnetic member and a sensor for a flushing device having an electric solenoid operated flush valve, said sensor comprising:

a control box;

a first radiation emitting source mounted in said control box;

a radiation detector adapted to detect reflected radiation from said first radiation emitting source mounted in said control box, said first radiation emitting source and said radiation detector forming a sensing unit;

a lens cover attached to said control box and adapted to permit radiation to pass therethrough to and from said sensing unit, said lens cover being spaced apart on one side thereof from said sensing unit; and a control circuit contained within said control box responsive to said sensing unit and connected to the solenoid for initiating operation of said flush valve, said control circuit including means approximate said lens cover for bypassing said sensing unit for deactivating said flush valve, said means for bypassing said sensing unit being magnetically activated when said magnetic member is disposed on the opposite side of said lens cover.

21. A sensor for a flushing device having an electric solenoid operated flush valve, said sensor comprising:

a control box;

a first radiation emitting source mounted in said control box;

a radiation detector adapted to detect reflected radiation from said first radiation emitting source mounted in said control box, said first radiation emitting source and said radiation detector forming a sensing unit;

a lens cover attached to said control box and adapted to permit radiation to pass therethrough to and from said sensing unit, said lens cover being spaced apart on one side thereof from said sensing unit;

a control circuit contained within said control box responsive to said sensing unit and connected to the solenoid for initiating operation of said flush valve, said control circuit including means approximate said lens cover for bypassing said sensing unit, said means for bypassing said sensing unit being magnetically activated when subjected to a magnet disposed on the opposite side of said lens cover, said means for bypassing said sensing unit including means for selectively activating said solenoid operated flush valve and for disabling said solenoid operated flush valve when said means for bypassing said sensing unit is activated by the magnet.

* * * * *

UNITED STATES PATENT AND TRADEMARK OFFICE

CERTIFICATE OF CORRECTION

PATENT NO. : 5,313,673

DATED : May 24, 1994

INVENTOR(S) : Robert E. Saadi, Christopher J. Ball and Makoto Kodaira

It is certified that error appears in the above-indentified patent and that said Letters Patent is hereby corrected as shown below:

Title page, item [56], References Cited, U.S. PATENT DOCUMENTS, "2,438,207 3/1948 Darby ... 4/99" should read --2,438,207 3/1948 Derby ... 4/99--.

Title page, item [56], References Cited, U.S. PATENT DOCUMENTS, "4,742,583 5/1983 Yoshida et al. ... 4/313" should read --4,742,583 5/1988 Yoshida et al. ... 4/313--.

Title page, item [56], References Cited, U.S. PATENT DOCUMENTS, "4,791,287 11/1990 Shaw ... 251/30.05" should read --4,971,287 11/1990 Shaw ... 251/30.05--.

Title page, References Cited, U.S. PATENT DOCUMENTS, add --OTHER PUBLICATIONS Hamlin, Inc., Reed and Proximity Switches, p. 648--.

Column 3 Line 17 after "plug" (first occurrence) insert --cap removed--.

Column 3 Line 52 after "flush valve" insert --10--.

UNITED STATES PATENT AND TRADEMARK OFFICE

CERTIFICATE OF CORRECTION

PATENT NO. : 5,313,673

DATED : May 24, 1994

INVENTOR(S) : Robert E. Saadi, Christopher J. Ball and Makoto Kodaira

Figure 15:
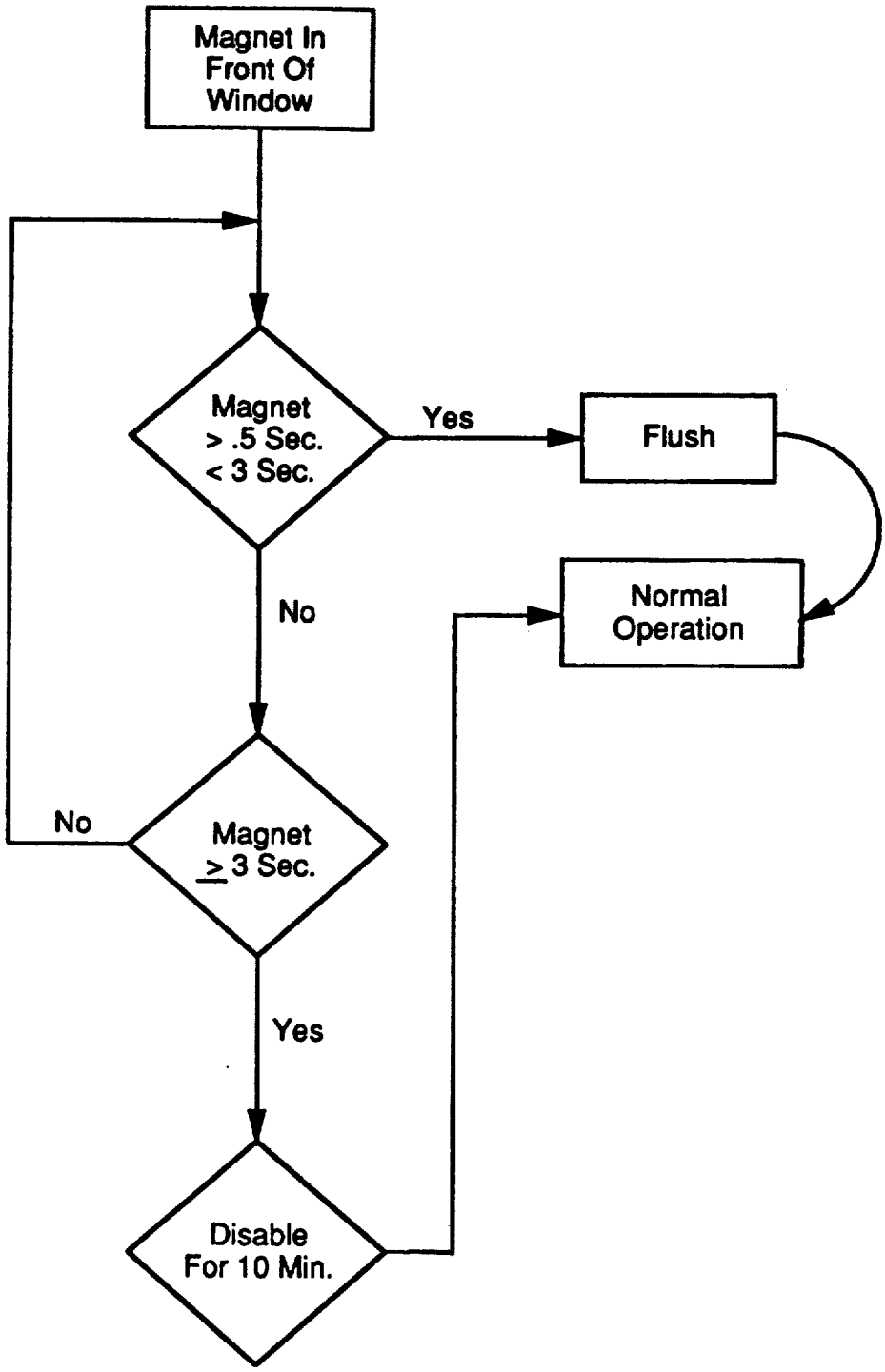
FIG. 15 is a schematic block diagram showing the operation of the sensor reed switch override.

It is certified that error appears in the above-indentified patent and that said Letters Patent is hereby corrected as shown below:

Column 7 Line 27 after "as" insert --illustrated in FIG. 15 is initiated by placing a magnet or--.

Column 7 Line 29 "dispressed" should read --disposed--.

Claim 18 Line 25 Column 10 after "one" delete ",".

Signed and Sealed this

Fourteenth Day of March, 1995

*Attest:*

*Attesting Officer*

BRUCE LEHMAN

*Commissioner of Patents and Trademarks*